US005617912A

United States Patent [19]

Ballewski et al.

[11] Patent Number: 5,617,912

[45] Date of Patent: Apr. 8, 1997

[54] PROCESS FOR PREPARING AND USING A CERAMIC SHELL AS A CASTING MOLD WITH REDUCING PROPERTIES

[76] Inventors: Heinrich Ballewski, Wittrahmsweg 39, 46506 Neukirchen Vluyn; Wolfgang Grossman, Liebrechtstrasse 106A, 47445 Moers, both of Germany

[21] Appl. No.: 422,342

[22] Filed: Apr. 14, 1995

[30] Foreign Application Priority Data

Apr. 14, 1904 [DE] Germany ..... 44 12 798.7

[51] Int. Cl.[6] ..... B22C 1/04

[52] U.S. Cl. ..... 164/517; 164/519; 164/523; 164/524; 164/529

[58] Field of Search ..... 164/517, 519, 164/523, 524, 529

[56] References Cited

U.S. PATENT DOCUMENTS

| | | | |
|---|---|---|---|
| 1,324,458 | 12/1919 | McIntosh . | |
| 2,731,690 | 1/1956 | Coupland et al. . | |
| 2,795,022 | 6/1957 | Shaw . | |
| 2,935,772 | 5/1960 | Shaw | 22/214 |
| 3,126,597 | 3/1964 | Operhall et al. . | |
| 3,153,826 | 10/1964 | Horton . | |
| 3,184,813 | 5/1965 | O'Shea . | |
| 3,296,666 | 1/1967 | Lirones . | |
| 3,474,851 | 10/1969 | Taylor . | |
| 3,656,983 | 4/1972 | Sulinski . | |
| 4,223,716 | 9/1980 | Ostrowski | 164/519 |

FOREIGN PATENT DOCUMENTS

| | | |
|---|---|---|
| 0020373b1 | 6/1984 | European Pat. Off. . |
| 126356 | 4/1968 | Germany . |
| 1900297 | 11/1969 | Germany . |
| 178952 | 2/1966 | U.S.S.R. . |
| 1066716 | 10/1981 | U.S.S.R. . |
| 1329881 | 12/1984 | U.S.S.R. . |
| 1470423 | 8/1987 | U.S.S.R. . |
| 672535 | 5/1952 | United Kingdom . |
| 725456 | 3/1953 | United Kingdom . |
| 1039757 | 8/1966 | United Kingdom . |
| 1160090 | 7/1969 | United Kingdom . |

OTHER PUBLICATIONS (Nike–) Nippon Kenmazai Kog May 7, 1980 Database WPI Derwent Publications Ltd., London, GB: AN 80–42553c.

*Primary Examiner*—Joseph J. Hail, III
*Assistant Examiner*—Randolph S. Herrick
*Attorney, Agent, or Firm*—McGlew and Tuttle

[57] ABSTRACT

The present invention pertains to a process for preparing ceramic shells as casting molds, wherein a) a pattern of a part to be cast, which pattern can be melted or dissolved out, is prepared, b) the pattern is dipped into a dip-coating composition of a slurry of a refractory material and a binder in order to form a wet coating on the pattern, c) a coarse refractory powder is sprinkled onto the coating, d) the coating is dried, and e) steps b), c) and d) are repeated until the mold shell has reached the desired thickness. A ceramic protective material is added to the dip-coating composition and/or to the coarse refractory powder. Carbon is introduced into the ceramic protective material during the preparation in the molten state. The carbon is able to chemically bind oxygen at the time of the cooling of the casting essentially at mold temperatures above the firing temperature of the casting mold and is thus able to prevent skin decarburization and surface defects in carbon-containing steels.

20 Claims, No Drawings

PROCESS FOR PREPARING AND USING A CERAMIC SHELL AS A CASTING MOLD WITH REDUCING PROPERTIES

FIELD OF THE INVENTION

The present invention pertains to a process for preparing ceramic shells as a casting mold, wherein a) a pattern of a part to be cast, which pattern can be melted or dissolved out, is prepared, b) the pattern is dipped into a dip-coating composition of a slurry of a refractory material and a binder in order to form a wet coating on the pattern, c) a coarse refractory powder is sprinkled onto the coating, d) the coating is dried, and e) steps b), c) and d) are repeated until the mold shell has reached the desired thickness.

BACKGROUND OF THE INVENTION

In such a process, nests of patterns made of wax or the like are provided with a stable ceramic layer of several mm in thickness by applying a plurality of dip coatings. The individual layers are dried or cured individually. Coarse refractory powder or sand is sprinkled onto the individual wet layers as a binding link to the next dip coating. The shells are fired after dewaxing, after which they can be used for casting while warm or after cooling.

Lost-wax mold shells which are prepared according to the above-described process and are used for open casting in air react with the ceramic layer facing the metal due to the formation of a skin decarburization in castings consisting of unalloyed and alloyed steels as well as by skin decarburization and pitting in the case of castings of 13% to 17% chrome steels and of steel grade 17-4 PH. Pitting may also occur in stainless and heat-resisting steels.

Attempts have been made to avoid the above-mentioned disadvantages by casting the lost-wax mold shells under vacuum, in containers in the absence of air, or under reducing protective gases or reducing protective materials.

The cooling of the mold shell under a protective gas is extremely expensive, and it becomes increasingly expensive as the mold assumes larger dimensions, and it does not always lead technically to tile goal of avoiding decarburization and pitting.

The addition of reducing materials, e.g., graphite, pyrolytic graphite and/or meltable metal compounds to avoid decarburization and pitting in the various steel alloys has been known.

British Patent No. 672,535 recommends the addition of coke, activated carbon, activated $Al_2O_3$ or $SiO_2$ or a metal, e.g., nickel or aluminum, to prevent skin decarburization during the casting of parts cast according to tile lost-wax process in a compact mold.

Difficulties due to the combustion of the carbon and its compounds and destruction of tile shell mold have systematically occurred especially when carbon, carbon-containing substances and/or metal compounds were added to the shell ceramic.

SUMMARY AND OBJECTS OF THE INVENTION

It is an object of the present invention to provide a process of the type described in the introduction, with which skin decarburization and pitting can be avoided with certainty in the case of carbon -containing alloys.

This object is attained by adding a ceramic protective material, into which carbon was introduced in the molten state of the ceramics protective material during its preparation and which is able to bind oxygen at the time of the cooling of tile casting essentially at shell temperatures above the firing temperature of the shells and which prevents the skin decarburization and the pitting of steels and alloys as a result, to the dip-coating composition and/or to the coarse refractory powder—stucco material—(sanding material) for the shell.

The ceramic protective material preferably consists of or essentially consists of 5.5 to 98 wt. % of $Al_2O_3$, the rest being $SiO_2$, with up to 12 wt. % of dispersively distributed and/or dissolved carbon. A melt or mullite, in which up to 6 wt. % of carbon are dispersed in a molten state of the melt mullite and/or dissolved, is preferably used.

The ceramic protective material consists of or essentially consists of technical-grade $Al_2\mathbf{0}_3$ containing 3 wt. % of dispersively distributed and/or dissolved carbon. The ceramic protective material is added to dip coating composition the filler of the first and second dip-coatings in an amount of 0.01 to 20 wt. %. The ceramic protective material is preferably added to the sanding (stuccoing) for the first and second dip-coating layers in an amount of 0.01 to 50 wt. % and preferably 5 to 20 wt. %. The ceramic protective coating may be added to dip coating composition the filler for the back-up dip-coating compositions in an amount of 0.01 to 20 wt. %. The ceramic protective material may be added to the sanding (stuccoing) for the back-up layers.

According to another variant of the invention, the ceramic protective material is preferably added in an amount of 0.01 to 30 wt. % and most preferably 5 wt. %. The ceramic protective material is added to the filler of the back-up dip-coating composition, which is used as a sealing dip.

According to a further feature of the invention, the ceramic protective material is added in an amount of 0.01 to 30 wt. % and even more preferably 5 to 8 wt. %.

According to a further aspect of the invention ceramic protective material for the filler and for the sanding for preparing ceramic shells as castings is provided based on the composition comprising (or essentially consisting of) 5.5 to 98 wt % of $Al_2O_3$, the rest being $SiO_2$ with up to 12 wt. % of dispersively distributed and/or dissolved carbon. The $Al_2O_3$ is preferably technical-grade containing 3 wt. % of dispersively distributed and/or dissolved carbon.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

The carbon-containing ceramic protective material is prepared by stirring carbon into a ceramic melt, e.g., a fireclay melt. This carbon reacts with the oxygen dissolved in the melt up to a certain degree.

Once this reaction is complete, it is possible to introduce carbon in the dispersed and/or dissolved form into the ceramic melt. Typical ceramic melts are single-component and/or two-component and/or three-component systems of the components $SiO_2Al_2O_3$ and $ZrO_2$.

The cooled melt regulus is crushed, ground and sized in the usual manner. Both flour for the filler with <200 mesh and particle sizes on the order of magnitude of <0.25 mm to 1.0 mm can be prepared.

The refractoriness of the ceramic protective material is not reduced by the dispersion and/or dissolution of the carbon or carbon compounds in it, and due to the carbon being enclosed in the actual refractory flour or granules as a dispersion and/or in the dissolved form, it is guaranteed that practically no combustion of the dispersively distributed and/or dissolved carbon takes place in the ceramic protective material at temperatures of up to 1,200° C. Shells which contain this protective material in both the filler of the first, second and back-up dip-coating compositions and/or in the first, second and back-up sanding (stuccoing) and of the sealing dip avoid skin decarburization and pitting in carbon-containing alloys due to the dispersively distributed carbon in the ceramic carrier reacting with the oxygen in the air after casting at temperatures above 1,200° C.

The preferred ceramic protective material is formed of 5.5 to 98 wt. % of $Al_2O_3$ with more than 0 and up to 12 wt. % of dispersively distributed and/or dissolved carbon with the remainder of protective material consisting essentially of $SiO_2$. As noted above, up to 6 wt. % of carbon is used dispersed in the molten state of the ceramic protective material and/or dissolved. The ceramic protective material may also consist essentially of or comprise technical-grade $Al_2O_3$ containing 3 wt. % of dispersively distributed and/or dissolved carbon as noted above.

The process using the ceramic protective material includes a) a pattern of a part to be cast, which pattern can be melted or dissolved out, is prepared, b) the pattern is dipped into a dip-coating composition of a slurry of a refractory material and a binder in order to form a wet coating on the pattern, c) a coarse refractory powder is sprinkled onto the coating, d) the coating is dried, and e) steps b), c) and d) are repeated until the mold shell has reached the desired thickness, wherein a ceramic protective material is added to the dip-coating composition and/or to the coarse refractory powder.

The ceramic protective material is as described above and is based on the introduction of carbon into the ceramic melt, namely introducing carbon to molten ceramic protective material during the preparation whereby the carbon is able to chemically bind with oxygen at the time of the cooling of the casting essentially at mold temperatures above the firing temperature of the casting mold and it is thus able to prevent skin decarburization and pitting on carbon-containing steels and alloys. The steps B, C and D noted above may be repeated until the mold shell has reached the desired thickness.

The ceramic protective material may be added to both the dip-coating composition and the sanding (stuccoing). Addition to the sealing dip is also possible. All three methods of addition lead to the result that C-containing alloys and steels do not undergo skin decarburization, and pitting does not occur. This is shown by various experiments.

Various examples of the process include:

I. Adding the ceramic protective material to the filler (ceramic power) of the first and second dip coatings in an amount of 0.01 to 20 wt. % and adding the ceramic protective material to the sanding (stuccoing) for the first and second dip-coatings in an amount of 0.01 to 50 wt. %. In this embodiment, the ceramic protective material is preferably added to the sanding (stuccoing) for the first and second dip-coating layers in an amount of 5 to 20 wt. %.

In this example, the ceramic protective material is preferably added to the filler for the back-up dip-coating compositions in an amount of 0.01 to 20 wt. %. The ceramic material may also be added to the sanding for the back-up layers.

The preferred addition of protective material in this example is 0.01 to 30 wt. % and the preferred amount is 5 wt. %.

II. As a second example, the amounts of the first example are followed with the addition that the ceramic protective material is added to the filler of the back-up dip-coating composition, which is used as a sealing dip. This ceramic protective material may be added in an amount from 0.01 to 30 wt. % and preferably 5 to 8 wt. %.

While specific embodiments of the invention have been shown and described in detail to illustrate the application of the principles of the invention, it will be understood that the invention may be embodied otherwise without departing from such principles.

What is claimed is:

1. Process for preparing ceramic shells as casting molds, comprising the steps of:

a) preparing a pattern of a part to be cast, which pattern can be melted or dissolved out;

b) dipping the pattern into a dip-coating composition of a slurry of a refractory material and a binder in order to form a wet coating on the pattern;

c) sprinkling a coarse refractory powder onto the coating;

d) drying the coating; and e) repeating steps b), c) and d) until a mold shell has reached the desired thickness;

f) firing the shell mold at a firing temperature; and g) adding to at least one of the dip-coating composition and to the coarse refractory powder, a ceramic protective material, the ceramic protective material having carbon introduced to molten protective ceramic material during preparation of the protective ceramic material, the carbon chemically binding to oxygen at the time of the cooling of the casting essentially at mold temperatures above the firing temperature of the casting mold, the ceramic protective material preventing skin decarburization and pitting on carbon-containing steels and alloys.

2. Process in accordance with claim 1, wherein said ceramic protective material consists essentially of 5.5 to 98 wt. % of $Al_2O_3$, up to 12 wt. % of dispersively distributed and/or dissolved carbon, the rest being $SiO_2$.

3. Process in accordance with claim 1, wherein said ceramic protective material includes technical-grade $Al_2O_3$ containing 3 wt. % of dispersively distribution and/or dissolved carbon.

4. Process in accordance with claim 1, wherein said the ceramic protective material is added to a filler of the first and second dip coatings in an amount of 0.01 to 20 wt. %.

5. Process in accordance with claim 1, wherein said the ceramic protective material is added to a stuccoing forming the coarse refractory power sprinkled onto a first and second dip-coating layers in an amount of 0.01 to 50 wt. %.

6. Process in accordance with claim 1, wherein said ceramic protective material is added to a stuccoing forming the coarse refractory powder sprinkled onto a first and second dip-coating layers in an amount of 5 to 20 wt. %.

7. Process in accordance with claim 1, wherein said ceramic protective material is added to a filler for the back-up dip-coating compositions in an amount of 0.01 to 20 wt. %.

8. Process in accordance with claim 1, wherein said ceramic protective material is added to a filler of the back-up dip-coating composition, which is used as a sealing dip.

9. Process in accordance with claim 1, wherein said ceramic protective material consists essentially of 5.5 to 98 wt. % of $Al_2O_3$, up to 12 wt. % of dispersively distribution and/or dissolved carbon, the rest being $SiO_2$.

10. Process in accordance with claim 1 or 2, wherein a mullite melt, in which up to 6 wt. % of carbon are dispersed in the molten state and/or dissolved, is used.

11. Process in accordance with claim 1 or 2, wherein a mullite melt, in which up to 6 wt. % of carbon are dispersed in the molten state and/or dissolved, is used.

12. Process in accordance with claim 1, wherein said ceramic protective material is added to a stuccoing forming the coarse refractory powder sprinkled onto back-up layers.

13. Process in accordance with claim 12, wherein said ceramic protective material is added in an amount of 5 wt. %.

14. Process in accordance with claim 12, wherein said ceramic protective material is added in an amount of 0.01 to 30 wt. %.

15. Process in accordance with claim 10, wherein said ceramic protective material is added to a filler of a back-up dip-coating composition, which is used as a sealing dip.

16. Process in accordance with claim 14, wherein said ceramic protective material is added in an amount of 0.01 to 30 wt. %.

17. Process in according to claim 14, wherein said ceramic protective material is added in an amount of 5 to 8 wt. %.

18. Process for preparing ceramic shells as casting molds, comprising the steps of:

a) preparing a pattern of a part to be cast, which pattern can be melted or dissolved out;

b) dipping the pattern into a dip-coating composition of a slurry of a refractory material and a binder in order to form a wet coating on the pattern;

c) sprinkling a coarse refractory powder onto the coating;

d) drying the coating; and e) repeating steps b), c) and d) until a mold shell has reached the desired thickness;

f) adding to at least one of the dip-coating composition and to the coarse refractory powder, a ceramic protective material, the ceramic protective material having carbon introduced to a molten protective ceramic material during preparation of the protective ceramic material;

g) firing the mold shell at a firing temperature; and h) forming one of a carbon-containing steel and carbon containing alloy casting in the fired mold shell whereby the mold shell carbon chemically binds to oxygen, at the time of cooling of the casting essentially at mold temperatures above the firing temperature of the casting mold, the ceramic protective material preventing skin decarburization and pitting on carbon-containing steels and alloys.

19. Process in accordance with claim 18, wherein said ceramic protective material consists essentially of 5.5 to 98 wt. % of $Al_2O_3$, up to 12 wt. % of dispersively distributed and/or dissolved carbon, the rest being $SiO_2$.

20. Process for preparing ceramic shells as casting molds, comprising the steps of:

a) preparing a pattern of a part to be cast, which pattern can be melted or dissolved out;

b) dipping the pattern into a dip-coating composition of a slurry of a refratory material and a binder in order to form a wet coating on the pattern;

c) sprinkling a coarse refractory powder onto the coating;

d) drying the coating; and e) repeating steps b), c) and d) until a mold shell has reached the desired thickness;

f) firing the mold shell at a firing temperature; and g) adding to at least one of the dip-coating composition and to the coarse refractory powder, a ceramic protective material, the ceramic protective material being formed by the steps of:

g1) forming a ceramic melt from 5.5 to 98 wt. % of $Al_2O_3$ g2) adding to the ceramic protective material more than 0 and up to 12 wt. % of dispersely distributed and/or dissolved carbon with up to 6 wt. % carbon dispersed in the ceramic melt in a molten state of the ceramic melt during preparation of the protective ceramic material, the carbon chemically binding to oxygen at the time of the cooling of the casting essentially at mold temperatures above the firing temperature of the casting mold, the ceramic protective material preventing skin decarburization and pitting on carbon-containing steels and alloys.

* * * * *